US011211032B2

(12) United States Patent
Kim

(10) Patent No.: US 11,211,032 B2
(45) Date of Patent: Dec. 28, 2021

(54) ELECTRONIC DEVICE FOR SUPPORTING TO CONTROL AUTO BRIGHTNESS OF DISPLAY

(71) Applicant: Samsung Electronics Co., Ltd., Suwon-si (KR)

(72) Inventor: Taeksoo Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/104,270

(22) Filed: Nov. 25, 2020

(65) Prior Publication Data

US 2021/0158777 A1 May 27, 2021

(30) Foreign Application Priority Data

Nov. 27, 2019 (KR) ..... 10-2019-0154122

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2320/0626* (2013.01); *G09G 2354/00* (2013.01); *G09G 2360/144* (2013.01)

(58) Field of Classification Search
None
See application file for complete search history.

(56) References Cited

U.S. PATENT DOCUMENTS 7,468,722 B2 12/2008 Ferguson
8,063,871 B2 11/2011 Lee et al.
8,223,117 B2 7/2012 Ferguson
9,898,949 B2 2/2018 Huang et al.
2012/0044274 A1 2/2012 Lee et al.

FOREIGN PATENT DOCUMENTS

JP 2000-208281 A 7/2000
JP 2019-120781 A 7/2019
KR 10-2007-0080399 A 8/2007
KR 10-2017-0098120 A 8/2017

OTHER PUBLICATIONS

International Search Report dated Mar. 30, 2021, issued in International Patent Application No. PCT/KR2020/016728.

*Primary Examiner* — Aneeta Yodichkas
(74) *Attorney, Agent, or Firm* — Jefferson IP Law, LLP

(57) ABSTRACT

An electronic device is provided. The electronic device includes a display, a sensor, a memory storing a reference brightness table including one-to-one matching between luminance points indicating luminance values corresponding to a luminance level of the display and reference illumination values in conjunction with the external illumination, and a processor. The processor controls the display at a first luminance corresponding to a first illumination measured by the sensor based on the reference brightness table, when a user input changing the display to a second luminance in a state where the first illumination is maintained is received, decreases or increases the number of first luminance points included between a second illumination adjacent to the first illumination and the first illumination and generates a user brightness table of matching illumination values between the first illumination and the second illumination with the decreased or increased first luminance points one-to-one.

20 Claims, 12 Drawing Sheets

| LUMINANCE POINT | 0 | 1 | 2 | 3 | 4 | 5 | 6 | 7 | 8 |
|---|---|---|---|---|---|---|---|---|---|
| LUMINANCE | 10 | 20 | 30 | 40 | 50 | 60 | 70 | 80 | 90 |
| REFERENCE ILLUMINATION | 5 | 15 | 26 | 39 | 100 | 400 | 600 | 800 | 1000 |
| USER ILLUMINATION | | | | | | 26 | | | |

| | | | RP | | | UP | | | |
|---|---|---|---|---|---|---|---|---|---|
| LUMINANCE POINT | 0 | 1 | 2 | 3 | 4 | 5 | 6 | 7 | 8 |
| REFERENCE LUMINANCE | 10 | 20 | 30 | 40 | 50 | 60 | 70 | 80 | 90 |
| REFERENCE ILLUMINATION | 5 | 15 | 26 | 39 | 100 | 400 | 600 | 800 | 1000 |
| REFERENCE BLOCK | BR1 | | – | BR2 | | | | | |
| REFERENCE LOCATION VALUE | 0 | 1 | – | 0 | 0.2 | 0.4 | 0.6 | 0.8 | 1 |
| USER BLOCK | BU1 | | | | | – | BU2 | | |
| USER LOCATION VALUE | 0 | 0.25 | 0.5 | 0.75 | 1 | – | 0 | 0.5 | 1 |
| USER ILLUMINATION | | | | | | 26 | | | |

$$\text{LOCATION VALUE} = \frac{\text{LUMINANCE POINT-MINIMUM POINT IN BLOCK}}{\text{NUMBER OF LUMINANCE POINTS IN BLOCK-1}}$$

401

FIG.4

RP L1 UP L2

| LUMINANCE POINT | 0 | 1 | 2 | 3 | 4 | 5 | 6 | 7 | 8 |
|---|---|---|---|---|---|---|---|---|---|
| REFERENCE LUMINANCE | 10 | 20 | 30 | 40 | 50 | 60 | 70 | 80 | 90 |
| REFERENCE ILLUMINATION | 5 | 15 | 26 | 39 | 100 | 400 | 600 | 800 | 1000 |
| REFERENCE BLOCK | BR1 | | – | BR2 | | | | | |
| REFERENCE LOCATION VALUE | 0 | 1 | – | 0 | 0.2 | 0.4 | 0.6 | 0.8 | 1 |
| USER BLOCK | BU1 | | | | | – | BU2 | | |
| USER LOCATION VALUE | 0 | 0.25 | 0.5 | 0.75 | 1 | – | 0 | 0.5 | 1 |
| USER ILLUMINATION | 5 | 7.5 | 10 | 12.5 | 15 | 26 | 39 | 500 | 1000 |

NP

P1 P2 NL $$\text{USER ILLUMINATION}(NL) = \frac{(L2-L1)\times(NP-P1)}{P2-P1} + L1$$

501

FIG.5

610 RP UP

| LUMINANCE POINT | 0 | 1 | 2 | 3 | 4 | 5 | 6 | 7 | 8 |
|---|---|---|---|---|---|---|---|---|---|
| REFERENCE LUMINANCE | 10 | 20 | 30 | 40 | 50 | 60 | 70 | 80 | 90 |
| REFERENCE ILLUMINATION | 5 | 15 | 26 | 39 | 100 | 400 | 600 | 800 | 1000 |
| REFERENCE BLOCK | BR1 | | – | 601 | | BR2 | | | |
| REFERENCE LOCATION VALUE | 0 | 1 | | 0 | 0.2 | 0.4 | 0.6 | 0.8 | 1 |
| USER BLOCK | BU1 | | | | | – | BU2 | | |
| USER LOCATION VALUE | 0 | 0 | 0 | 0 | 1 | – | 0 | 0.5 | 1 |
| USER ILLUMINATION | 5 | 5 | 5 | 5 | 15 | 26 | 39 | 500 | 1000 |

630 620

FIG.6

UP2 UP1

| LUMINANCE POINT | 0 | 1 | 2 | 3 | 4 | 5 | 6 | 7 | 8 |
|---|---|---|---|---|---|---|---|---|---|
| REFERENCE LUMINANCE | 10 | 20 | 30 | 40 | 50 | 60 | 70 | 80 | 90 |
| REFERENCE ILLUMINATION | 5 | 15 | 26 | 39 | 100 | 400 | 600 | 800 | 1000 |
| FIRST USER ILLUMINATION | | | | | | 26 | | | |
| SECOND USER ILLUMINATION | | | | | 400 | | | | |

701 702

UP2

| LUMINANCE POINT | 0 | 1 | 2 | 3 | 4 | 5 | 6 | 7 | 8 |
|---|---|---|---|---|---|---|---|---|---|
| REFERENCE LUMINANCE | 10 | 20 | 30 | 40 | 50 | 60 | 70 | 80 | 90 |
| REFERENCE ILLUMINATION | 5 | 15 | 26 | 39 | 100 | 400 | 600 | 800 | 1000 |
| SECOND USER ILLUMINATION | | | | | 400 | | | | |

710 720

FIG.7

UP2 UP1

| LUMINANCE POINT | 0 | 1 | 2 | 3 | 4 | 5 | 6 | 7 | 8 |
|---|---|---|---|---|---|---|---|---|---|
| REFERENCE LUMINANCE | 10 | 20 | 30 | 40 | 50 | 60 | 70 | 80 | 90 |
| REFERENCE ILLUMINATION | 5 | 15 | 26 | 39 | 100 | 400 | 600 | 800 | 1000 |
| FIRST USER ILLUMINATION | | | | | | 26 | | | |
| SECOND USER ILLUMINATION | | | | | 400 | | | | |

801 802

UP1 UP2

| LUMINANCE POINT | 0 | 1 | 2 | 3 | 4 | 5 | 6 | 7 | 8 |
|---|---|---|---|---|---|---|---|---|---|
| REFERENCE LUMINANCE | 10 | 20 | 30 | 40 | 50 | 60 | 70 | 80 | 90 |
| REFERENCE ILLUMINATION | 5 | 15 | 26 | 39 | 100 | 400 | 600 | 800 | 1000 |
| THIRD USER ILLUMINATION | | | | 26 | 400 | | | | |

810 820

FIG.8

| LUMINANCE POINT | 0 | 1 | 2 | 3 | 4 | 5 | 6 | 7 | 8 |
|---|---|---|---|---|---|---|---|---|---|
| REFERENCE ILLUMINATION | 5 | 15 | 26 | 39 | 100 | 400 | 600 | 800 | 1000 |
| REFERENCE LUMINANCE | 10 | 20 | 30 | 40 | 50 | 60 | 70 | 80 | 90 |
| Lux #1 | | 10 | | | | | | | |
| Lux #2 | | | | | | | 180 | | |
| Lux #3 | | 4 | | | | | 200 | | |
| ... | ... | | | | | | | | |
| Lux #N | | 8 | | 20 | | | 30 | | |
| AVERAGE LUX | | 9 | | 20 | | | 195 | | |
| EVENT LUX | | | | | | | 30 | | |

FIG.9

ELECTRONIC DEVICE FOR SUPPORTING TO CONTROL AUTO BRIGHTNESS OF DISPLAY

CROSS-REFERENCE TO RELATED APPLICATION(S)

This application is based on and claims priority under 35 U.S.C. § 119(a) of a Korean patent application number 10-2019-0154122, filed on Nov. 27, 2019, in the Korean Intellectual Property Office, the disclosure of which is incorporated by reference herein its entirety.

BACKGROUND

1. Field

The disclosure relates to an electronic device for supporting to control auto brightness of a display.

2. Description of Related Art

With the development of electronic technology, various types of electronic products have been developed and distributed. Particularly, recently, the distribution of electronic devices, such as smartphones, tablet personal computers (PCs), and wearable devices, having various functions has been expanded. Such an electronic device may include a display for outputting visual information. The power consumption of the display has a huge part of the power consumption of the electronic device. As the display becomes larger in size depending on the trend of becoming larger and larger in the display, the power consumption of the display may be more increased. Because there exists a limit to the capacity of the battery of the electronic device, research and development for saving power consumed by the display have been carried out.

Furthermore, to save the power of the electronic device and ensure the visibility of the user, the brightness of the display be automatically adjusted according to external illumination detected by an illumination sensor.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an electronic device for generating an auto brightness table specialized in a user, when a brightness of a display is changed in an auto brightness mode by the user.

Additional aspects will be set forth in part in the description which follows and, in part, will be apparent from the description, or may be learned by practice of the presented embodiments.

In accordance with an aspect of the disclosure, an electronic device is provided. The electronic device includes a display, a sensor configured to measure external illumination, a memory storing a reference brightness table including one-to-one matching between luminance points indicating luminance values, each of which corresponds to a luminance level of the display—the luminance points having an interval depending on the luminance level—and reference illumination values in conjunction with the external illumination, and a processor operatively connected with the display, the sensor, and the memory. The processor may be configured to control the display at a first luminance corresponding to a first illumination measured by the sensor based on the reference brightness table and, when a user input changing the display to a second luminance in a state where the first illumination is maintained is received, decrease or increase the number of first luminance points included between a second illumination adjacent to the first illumination and the first illumination and generate a user brightness table of matching illumination values between the first illumination and the second illumination with the decreased or increased first luminance points one-to-one.

In accordance with another aspect of the disclosure, an electronic device is provided. The electronic device includes a display, a sensor configured to measure external illumination, a memory storing a reference brightness table including luminance points corresponding one-to-one to luminance values, the luminance values being represented as consecutive values and having a luminance difference of a certain level, and reference illumination values mapped one-to-one to the luminance points, and a processor configured to adjust a luminance of the display at a brightness of luminance corresponding to a specific luminance point depending on the external illumination detected by the sensor. The processor may be configured to, when receiving a user input associated with changing the reference illumination value, subdivide at least some of lower reference illumination values, each of which has an illumination value less than the changed reference illumination value, to generate more lower user illumination values than the number of the lower reference illumination values and generate a user brightness table including the lower user illumination values.

In accordance with another aspect of the disclosure, an electronic device is provided. The electronic device includes a display, a sensor configured to measure external illumination, a memory storing a reference brightness table including luminance points corresponding one-to-one to luminance values, the luminance values being represented as consecutive values and having a luminance difference of a certain level, and reference illumination values mapped one-to-one to the luminance points, and a processor configured to adjust a luminance of the display at a brightness of luminance corresponding to a specific luminance point depending on the external illumination detected by the sensor. The processor may be configured to, when receiving a user input associated with changing the reference illumination value, subdivide at least some of upper reference illumination values, each of which has an illumination value greater than the changed reference illumination value, to generate more upper user illumination values than the number of the upper reference illumination values and generate a user brightness table including the upper user illumination values.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which:

FIG. 4 is a drawing illustrating a process of generating a user table depending on a first scheme according to an embodiment of the disclosure;

FIG. 5 is a drawing illustrating a method for obtaining user illumination in FIG. 4 according to an embodiment of the disclosure;

FIG. 6 is a drawing illustrating a process of generating a user table depending on a second scheme according to an embodiment of the disclosure;

FIG. 7 is a drawing illustrating an example of a method for generating a user table for a plurality of user points according to an embodiment of the disclosure;

FIG. 8 is a drawing illustrating another example of a method for generating a user table for a plurality of user points according to an embodiment of the disclosure;

FIG. 9 is a drawing illustrating a method for using user illumination obtained by an auto brightness method according to an embodiment of the disclosure;

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications, of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
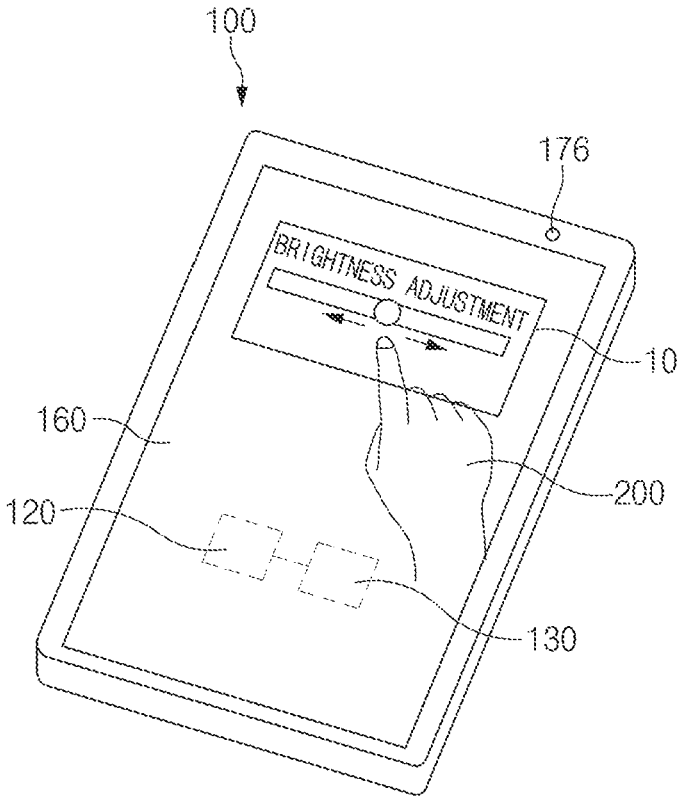
FIG. 1 is a drawing illustrating a method for adjusting brightness of a display in an electronic device according to an embodiment of the disclosure.
Figure 2:
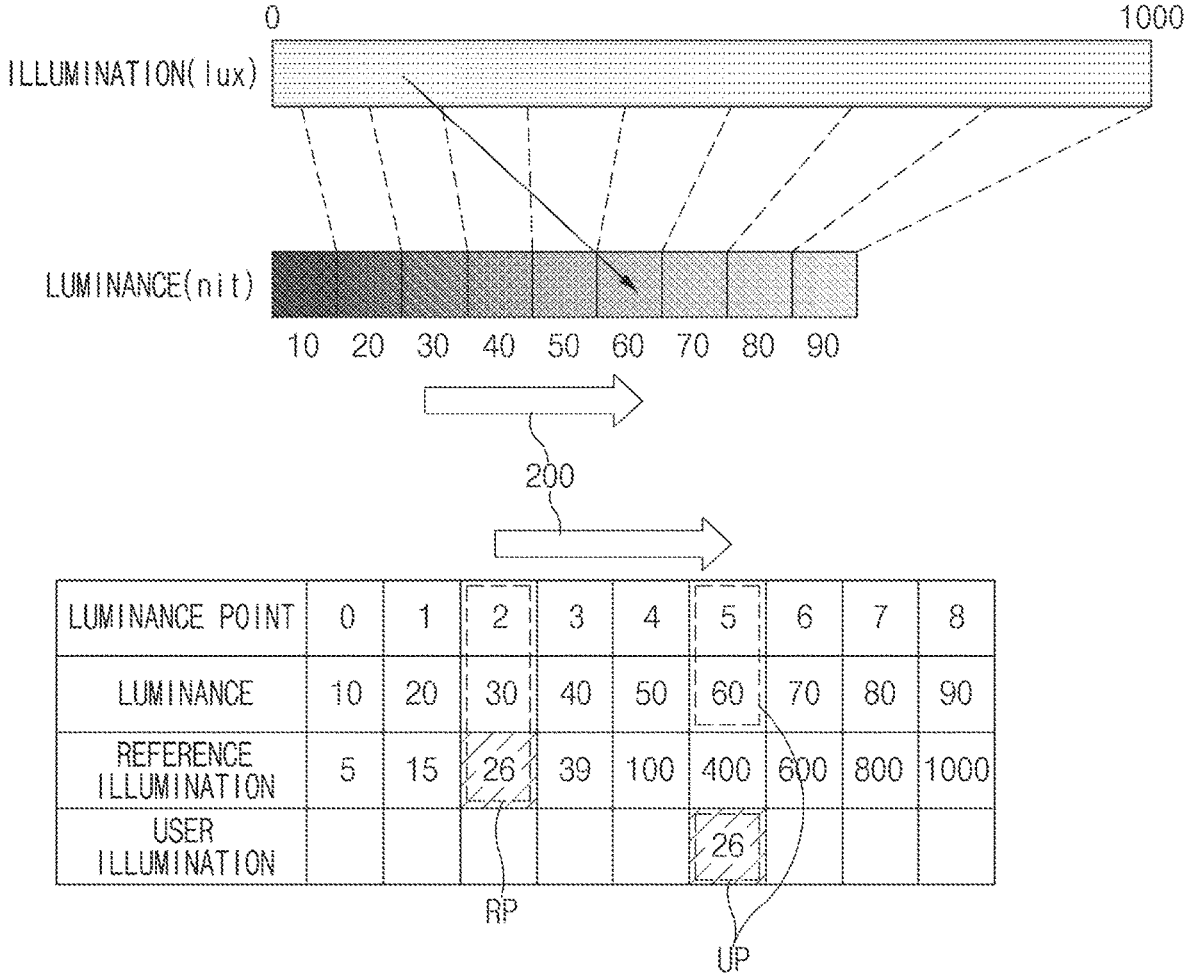
FIG. 2 is a table illustrating an example of an auto brightness table used in an auto brightness operation according to an embodiment of the disclosure.
Figure 3:
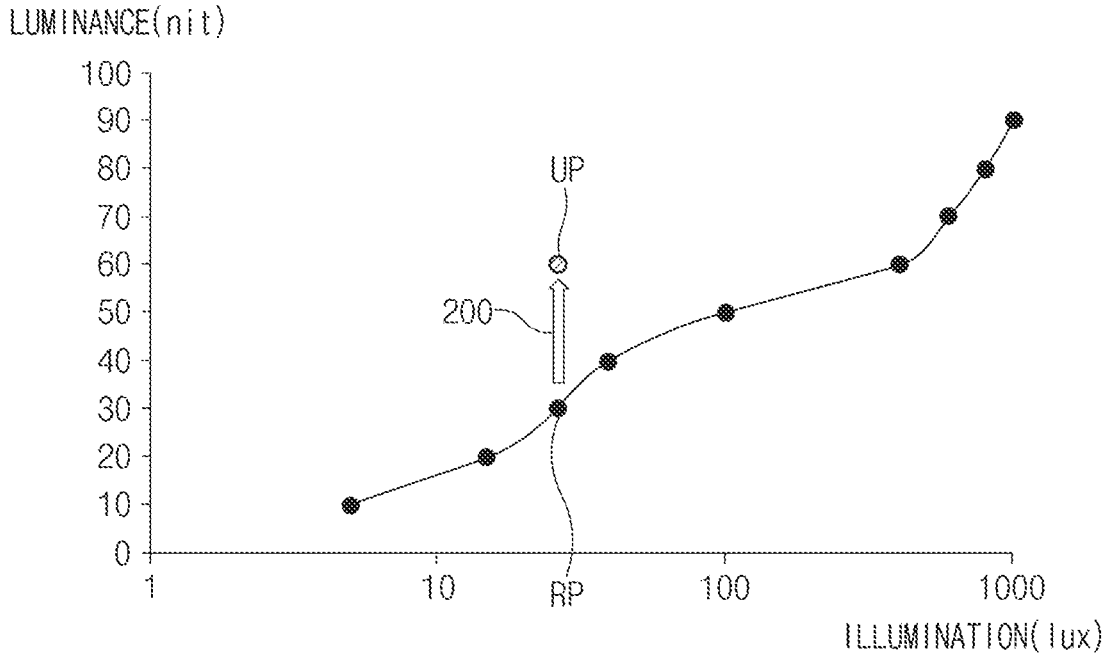
FIG. 3 is a graph illustrating matching of illumination and luminance in an auto brightness table of FIG. 2 according to an embodiment of the disclosure.

FIG. 1 is a drawing illustrating a method for adjusting brightness of a display in an electronic device according to an embodiment of the disclosure. FIG. 2 is a table illustrating an example of an auto brightness table used in an auto brightness operation according to an embodiment of the disclosure. FIG. 3 is a graph illustrating matching of illumination and luminance in an auto brightness table of FIG. 2 according to an embodiment of the disclosure.

Referring to FIGS. 1 to 3, an electronic device 100 may include a processor 120, a memory 130, a display 160, or a sensor 176. For example, the processor 120 may be operatively connected with the memory 130, the display 160, or the sensor 176. In various embodiments, the electronic device 100 may further include at least one or more other components.

According to an embodiment, the electronic device 100 may be set to an auto brightness mode to operate. For example, the processor 120 may measure illumination (hereinafter referred to as "external illumination") of the outside (or a surrounding environment) of the electronic device 100 by means of the sensor 176 (e.g., an illumination sensor). The processor 120 may control a luminance (or brightness) of the display 160 based on the measured external illumination. For example, the external illumination may refer to brightness outside the electronic device 100 according to various external light sources (e.g., the sun and artificial lighting). Referring to FIG. 2, the external illumination may be represented as consecutive values (e.g., 0 to 1000). The luminance may be represented as non-consecutive specific values (e.g., 10, 20, 30, 40, 50, 60, 70, 80, and 90). The external illumination may display a brightness of a wider range than the luminance. In an embodiment, the processor 120 may store an auto brightness table (e.g., a lookup table) of matching specific values of the external illumination with specific values of the luminance one-to-one in the memory 130. The processor 120 may control the display 160 using luminance corresponding to the measured external illumination with reference to the auto brightness table.

According to an embodiment, the memory 130 may store a reference table which is basically used in an auto brightness mode by the electronic device 100 (e.g., when there is no user input 200 adjusting brightness). For example, in the reference table, the luminance of the display 160 may include specified values. As an example, the luminance of the display 160 may consist of values (e.g., 10, 20, 30, 40, 50, 60, 70, 80, and 90 nit) having a constant interval. Alternatively, the luminance of the display 160 may consist of values having a non-constant interval for low-illumination visibility. The luminance may be correspondingly matched to a specified luminance point (e.g., 0, 1, 2, 3, 4, 5, 6, 7, or 8). The reference illumination may be matched one-to-one to the luminance (or the luminance point). The reference illumination may include specific values (e.g., 5, 15, 26, 39, 100, 400, 600, 800, and 1000 lux) having an unspecific interval. Such that, the more the luminance point increases, the more the luminance and the reference illumination increase, the luminance and the reference illumination may be matched to the luminance point.

According to an embodiment, the processor 120 may receive the user input 200 changing a brightness of the display 160 at current external illumination (e.g., 26 lux) (e.g., touch and move a brightness point of a brightness adjustment object 10 displayed on the display 160). For example, referring to FIGS. 2 and 3, when the current external illumination is 26 lux, the processor 120 may control the display 160 at a brightness of 30 nit based on the reference table. In this case, when the user input 200 changing the brightness of the display 160 to 60 nit is received, the processor 120 may control the display 160 at a brightness of 60 nit. Furthermore, the processor 120 may generate a user table of matching 60 nit (or luminance point 5) to 26 lux. The processor 120 may calculate illumination values (e.g., user illumination) corresponding to other luminance points of the user table and may store the user table in the memory 130.

In FIGS. 4 to 6 described below, a method for generating the user table will be described in detail. Hereinafter, a luminance point (e.g., luminance point 2) on the reference table corresponding to the current external illumination may be defined as a reference point RP. A luminance point (e.g. luminance point 5) on the reference table corresponding to the current external illumination may be defined as a user point UP.

FIG. 4 is a drawing illustrating a process of generating a user table depending on a first scheme (e.g., an illumination rate change scheme) according to an embodiment of the disclosure. FIG. 5 is a drawing illustrating a method for obtaining user illumination in FIG. 4 according to an embodiment of the disclosure.

Referring to FIGS. 1, 4, and 5, an electronic device 100 may be set to an auto brightness mode to operate. For example, a processor 120 may measure current external illumination (e.g., 26 lux) by means of a sensor 176. The processor 120 may display a display 160 at a reference luminance (e.g., 30 nit) corresponding to the current external illumination (or a reference point RP) based on a reference table (e.g., a reference table of FIG. 2).

According to an embodiment, the processor 120 may receive a user input 200 changing a brightness of the display 160 at the current external illumination (e.g., touch and move a brightness point of a brightness adjustment object 10 displayed on the display 160). For example, the processor 120 may change a brightness of the display 160 (e.g., change 30 nit to 60 nit) based on the user input 200. The processor 120 may generate a new user table on the basis of the current external illumination and the changed brightness of the display 160.

According to an embodiment, the processor 120 may divide luminance points into two blocks on the basis of the reference block RP (e.g., luminance point 2) in the reference table. For example, a first reference block BR1 may include luminance points (e.g., luminance point 0 and luminance point 1) less than the reference point RP. A second reference block BR2 may include luminance points (e.g. luminance points 0 to 8) greater than the reference point RP. Furthermore, the processor 120 may divide luminance points into two blocks on the basis of a user point UP (e.g., luminance point 5) in the user table. For example, a first user block BU1 may include luminance points (e.g., luminance points 0 to 4) less than the user point UP. A second user block BU2 may include luminance points (e.g. luminance points 6 to 8) greater than the user point UP.

According to an embodiment, the processor 120 may calculate a reference location value corresponding to each luminance point with respect to the first reference block BR1 and the second reference block BR2. For example, the processor 120 may calculate reference location values of the first reference block BR1 and the second reference block BR2 based on a location value calculation formula 401.

According to an embodiment, the processor 120 may calculate a user location value corresponding to each luminance point with respect to the first user block BU1 and the second user block BU2. For example, the processor 120 may calculate user location values of the first user block BU1 and the second user block BU2 based on the location value calculation formula 401.

According to an embodiment, the processor 120 may calculate user illumination based on reference illumination, the reference location value, and the user location value. For example, the user illumination of the first user block BU1 may be calculated using a reference illumination and a reference location value of the first reference block BR1. The user illumination of the second user block BU2 may be calculated using a reference illumination and a reference location value of the second reference block BR2. For example, referring to FIG. 5, in a user illumination NL included in the second user block BU2, the processor 120 may select reference location values P1 and P2 (e.g., 0.4 and 0.6) close to a user location value NP (e.g., 0.5) corresponding to the user illumination NL from the second reference block BR2. The processor 120 may select reference illumination values L1 and L2 (e.g., 400 lux and 600 lux) corresponding to the reference location values P1 and P2. The processor 120 may calculate the user illumination NL (e.g., 500 lux) to be obtained based on a user illumination calculation formula 501. Likewise, the processor 120 may also calculate a user illumination of the first user block BU1 using the above-mentioned method.

As described above, the processor 120 may generate a new user table (or update an auto brightness table) used for an auto brightness operation based on a luminance point (e.g., the user point UP) changed for current external illumination. In the generated user table, one user block (e.g., the first user block BU1) may be more expanded (or enlarged) than a corresponding reference block (e.g., the first reference block BR1) (e.g., the first user block BU includes luminance points greater than the first reference block BR1). In the generated user table, another user block (e.g., the second user block BU2) may be more reduced than a corresponding reference block (e.g., the second reference block BR2) (e.g., the second user block BU2 includes luminance points less than the second reference block BR2).

FIG. 6 is a drawing illustrating a process of generating a user table depending on a second scheme (e.g., a block shift scheme) according to an embodiment of the disclosure.

Referring to FIGS. 1 and 6, an electronic device 100 may be set to an auto brightness mode to operate. For example, a processor 120 may measure current external illumination (e.g., 26 lux) by means of a sensor 176. The processor 120 may display a display 160 at reference luminance (e.g., 30 nit) corresponding to the current external illumination (or a reference point RP) based on a reference table (e.g., a reference table of FIG. 2).

According to an embodiment, the processor 120 may receive a user input 200 changing a brightness of the display 160 at the current external illumination (e.g., touch and move a brightness point of a brightness adjustment object 10 displayed on the display 160). For example, the processor 120 may change a brightness of the display 160 (e.g., change 30 nit to 60 nit) based on the user input 200. The processor 120 may generate a new user table on the basis of the current external illumination and the changed brightness of the display 160. As an embodiment, the processor 120 may set reference blocks (e.g., a first reference block BR1 and a second reference block BR2) and user blocks (e.g., a first user block BU1 and a second user block BU2) shown in FIG. 4 and may calculate reference location values for the reference blocks.

According to an embodiment, the processor 120 may calculate user illumination values depending on a method of FIG. 5 with respect to a user block (e.g., the second user block BU2) which is more reduced than a reference block (e.g., the second reference block BR2).

According to an embodiment, the processor 120 may apply a second scheme (e.g., a block shift scheme) with respect to a user block (e.g., the first user block BU1) more expanded (or enlarged) than a reference block (e.g., the first reference block BR1). For example, the processor 120 may use reference illumination values 610 of the first reference block BR1 in the same manner as some user illumination values 620 of the first user block BU1 (referring to an arrow 601 of FIG. 6). The processor 120 may set the remaining illumination values 630 except for the user illumination values 620 in the first user block BU1 to a specified value (e.g., a minimum value, −1, or null among the user illumination values 620). Thus, the processor 120 may set the user illumination values 620 and 630 of the second user block BU2 without special calculation, and a time when the user table is generated may be shortened.

FIG. 7 is a drawing illustrating an example of a method for generating a user table for a plurality of user points according to an embodiment of the disclosure.

Referring to FIGS. 1 and 7, an electronic device 100 may be set to an auto brightness mode to operate. For example, a processor 120 may measure current external illumination (e.g., 26 lux) by means of a sensor 176. The processor 120 may display a display 160 at reference luminance (e.g., 30 nit) corresponding to the current external illumination (or a reference point RP) based on a reference table (e.g., a reference table of FIG. 2).

According to an embodiment, the processor 120 may receive a first user input 701 changing a brightness of the display 160 from luminance point 2 (e.g., 30 nit) to luminance point 5 (e.g., 60 nit) at current external illumination (e.g., 26 lux) (e.g., touch and move a brightness point of a brightness adjustment object 10 displayed on the display 160). The processor 120 may designate luminance point 5 as a first user point UP1 based on methods of FIGS. 4 and 5 and may generate a new user table (e.g., calculate a first user illumination) for a brightness of the display 160 on the basis of the first user point UP1.

According to an embodiment, after a specific time elapses after generating a user table including the first user illumination, the processor 120 may control the display 160 at reference luminance (e.g., 60 nit) corresponding to current external illumination (e.g., 400 lux) depending on a reference table (e.g., reference luminance and reference illumination). The processor 120 may receive a second user input 702 changing a brightness of the display 160 from luminance point 5 (e.g., 60 nit) to luminance point 4 (e.g., 50 nit) at the current external illumination (e.g., 40 lux). The processor 120 may designate luminance point 4 as a second user point UP2. In this case, when the second user point UP2 is less than the first user point UP1, the processor 120 may delete the first user illumination and may generate a second user illumination on the basis of the second user point UP2. The processor 120 may calculate the remaining portions 710 and 720 of the second user illumination on the basis of the second user point UP2 based on methods of FIGS. 4 and 5 and may generate a new user table (e.g., calculate the second user illumination).

FIG. 8 is a drawing illustrating another example of a method for generating a user table for a plurality of user points according to an embodiment of the disclosure.

Referring to FIGS. 1 and 8, an electronic device 100 may be set to an auto brightness mode to operate. For example, a processor 120 may receive a first user input 801 changing a brightness of a display 160 from luminance point 2 (e.g., 30 nit) to luminance point 5 (e.g., 60 nit) at current external illumination (e.g., 26 lux) (e.g., touch and move a brightness point of a brightness adjustment object 10 displayed on the display 160). The processor 120 may designate luminance point 5 as a first user point UP1 based on methods of FIGS. 4 and 5 and may generate a new user table (e.g., calculate a first user illumination) for a brightness of the display 160 on the basis of the first user point UP1.

According to an embodiment, after a specific time elapses after generating the user table including the first user illumination, the processor 120 may control the display 160 at reference luminance (e.g., 60 nit) corresponding to current external illumination (e.g., 400 lux) depending on a reference table (e.g., reference luminance and reference illumination). The processor 120 may receive a second user input 802 changing a brightness of the display 160 from luminance point 5 (e.g., 60 nit) to luminance point 4 (e.g., 50 nit) at the current external illumination (e.g., 40 lux). The processor 120 may designate luminance point 4 as a second user point UP2. In this case, when the second user point UP2 is less than the first user point UP, the processor 120 may combine the first user point UP1 and the second user point UP2 to generate a new user table (e.g., calculate a third user illumination). For example, the processor 120 may set the first user point UP1 to a luminance point which is lower than the second user point UP2 by one stage (e.g., set the first user point UP1 to luminance point 3, when the second user point UP2 is luminance point 4). The processor 120 may calculate third user illumination values 810 less than the first user point UP1 on the basis of the first user point UP1 (e.g., 26 nit) based on methods of FIGS. 4 and 5. The processor 120 may calculate the third user illumination values 820 greater than the second user point UP2 on the basis of the second user point UP2 (e.g., 400 nit) based on the methods of FIGS. 4 and 5.

FIG. 9 is a drawing illustrating a method for using user illumination obtained by an auto brightness method according to an embodiment of the disclosure.

Referring to FIGS. 1 and 9, a processor 120 may store user illustration corresponding to a user point in a memory 130 based on a user input 200 changing a brightness of a display 160. For example, a processor 120 may store user illumination samples Luces #1 to #N satisfying a specified condition of use (e.g., when the generated user table is used over a specified time) in the form of a list. For example, the first user illumination sample Lux #1 may be a case where a user input changing a luminance of the display 160 to 20 nit in a state where an external illumination of 10 lux is received. The second user illumination sample Lux #2 may be a case where a user input changing a luminance of the display 160 to 70 nit in a state where an external illumination of 180 lux is received. The third user illumination sample Lux #3 may be a case where two user inputs are received. The third user illumination sample Lux #3 may be a case where a user input changing a brightness of the display 160 to 20 nit in a state where an external illumination of 4 lux and a user input changing a luminance of the display 160 to 70 nit in a state where an external illumination of 200 lux are received. The Nth user illumination sample Lux #N may be a case where three user inputs are received. The Nth user illumination sample Lux #N may be a case where a user input changing a brightness of the display 160 to 20 nit in a state where an external illumination of 8 lux, a user input changing a luminance of the display 160 to 40 nit in a state where an external illumination of 20 lux, and a user input changing a luminance of the display 160 to 70 nit in a state where an external illumination of 30 lux are received.

According to an embodiment, after a specified time elapses, the processor 120 may calculate an average illumination sample (an average Lux) of the user illumination samples (Luces #1 to #N). For example, the processor 120 may calculate average illumination values (e.g., 9 lux, 20 lux, and 195 lux) for luminance points (e.g., luminance points 1, 3, and 6) corresponding to the user illumination samples Luces #1 to #N. The processor 120 may calculate the remaining luminance points (e.g., luminance points 0, 2, 4, 5, 7, and 8) except for the luminance points (e.g., luminance points 1, 3, and 6) corresponding to the user illumination samples Luces #1 to #N using methods of FIGS. 4 to 6 to generate a user average table. The processor 120 may store the user average table in the memory 130 and may recommend the user average table to the user.

According to an embodiment, the processor 120 may store an illumination value (e.g., luminance point 6 of Lux #N), which has a difference of a specific value or more with the average illumination value among the user illumination samples Luces #1 to #N, as an event illumination sample (an event Lux) (e.g., when there is a need to adjust the display 160 to be bright although a surrounding environment is dark). The processor 120 may generate an event brightness table by means of methods of FIGS. 4 to 6 based on the event illumination sample (the event Lux). The processor 120 may store the event brightness table in the memory 130 and may recommend the event brightness table to the user in a situation similar to the event illumination sample (the event Lux) (e.g., when a user input changing a brightness of the display 160 to 70 nit in a state where an external illumination of 30 lux is received).

Figure 10:
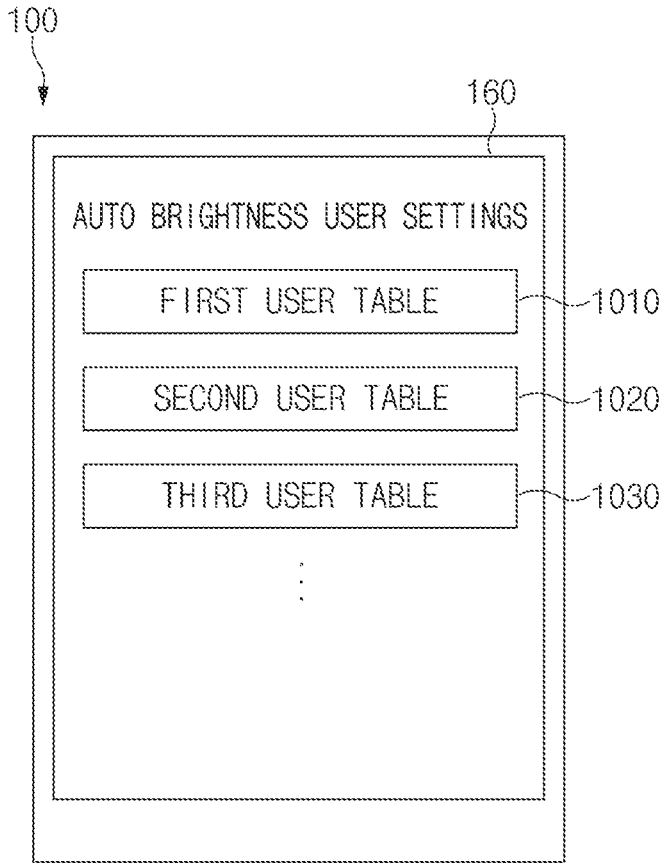
FIG. 10 is a drawing illustrating a method for using auto brightness user settings according to an embodiment of the disclosure.

FIG. 10 is a drawing illustrating a method for using auto brightness user settings according to an embodiment of the disclosure.

Referring to FIGS. 1 and 10, an electronic device 100 may provide various auto brightness user settings on a display 160. For example, a processor 120 may generate a user table (e.g., a first user table 1010, a second user table 1020, or a third user table 1030) based on a user input satisfying a specified condition of use (e.g., a condition of adjusting a brightness of the display 160 in an auto brightness mode and using the adjusted display 160 over a specific time) and may store the generated user table in a memory 130. The processor 120 may generate the user table (e.g., the first user table 1010, the second user table 1020, or the third user table 1030) by means of methods of FIGS. 4 to 6. For example, the first user table 1010 may be a user average table described with reference to FIG. 7. The second user table 1020 may be an event brightness table described with reference to FIG. 9. The third user table 1030 may be an auto brightness table generated when battery capacity is less than or equal to a specific value.

According to an embodiment, the processor 120 may determine an order where user tables are recommended based on a specified weight. For example, a processor 120 may first recommend a user table where a percentage of use (e.g., a time when the user table is used/a total time when the auto brightness mode is used) is high.

Figure 11:
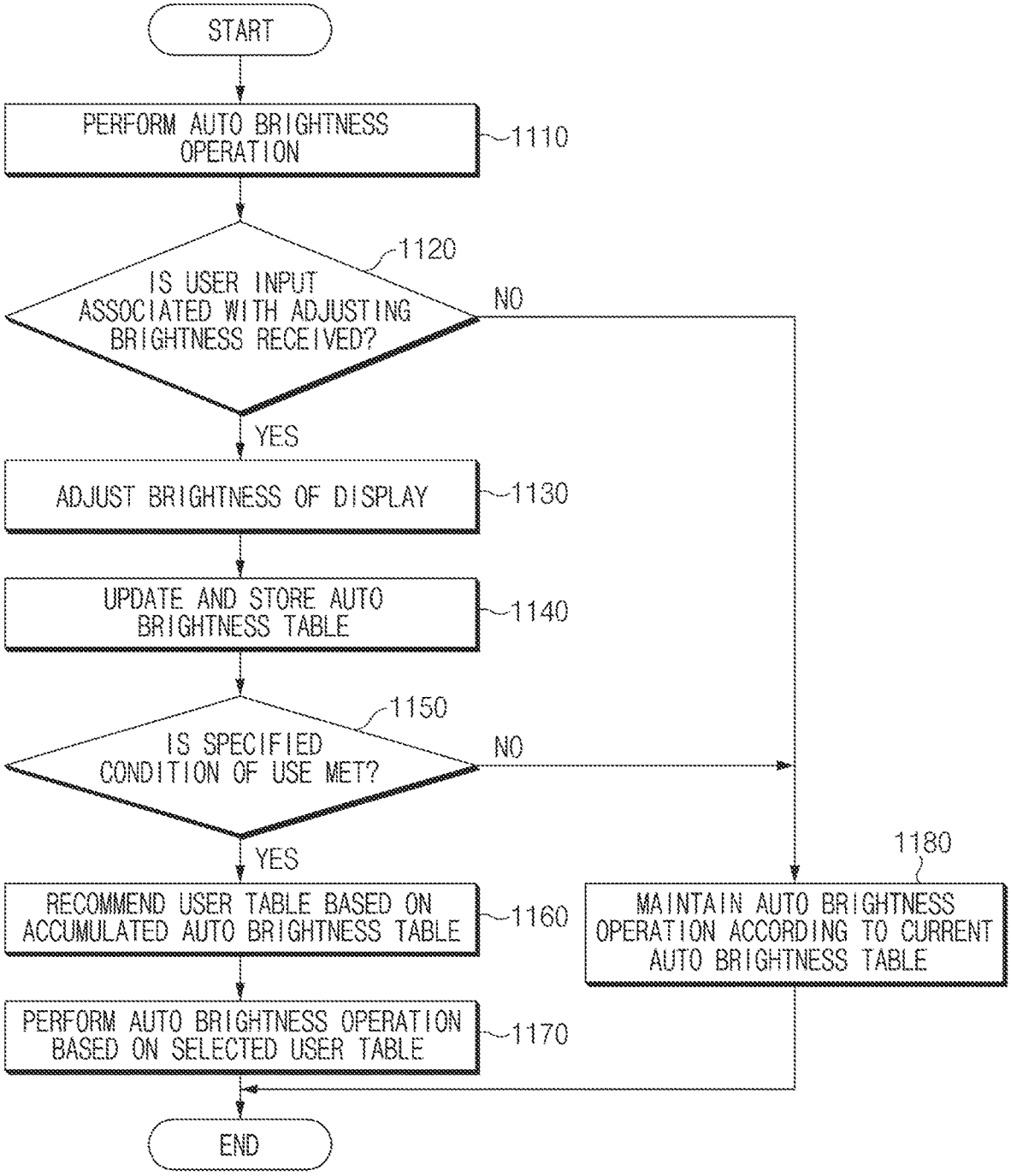
FIG. 11 is a flowchart illustrating an auto brightness operation method of an electronic device according to an embodiment of the disclosure.

FIG. 11 is a flowchart illustrating an auto brightness operation method of an electronic device according to an embodiment of the disclosure.

Referring to FIGS. 1 and 11, a processor 120 of an electronic device 100 may update an auto brightness table depending on a user input in an auto brightness mode and may recommend an auto brightness table specialized in a user depending on whether a specified condition of use is met.

According to an embodiment, in operation 1110, the electronic device 100 may control a display 160 in the auto brightness mode. For example, the processor 120 of the electronic device 100 may adjust a brightness of the display 160 based on a reference table stored in a memory 130 in conjunction with an auto brightness operation. The processor 120 may measure an external illumination of the electronic device 100 by means of a sensor 176 and may control the display 160 to have luminance corresponding to the external illumination based on the reference table.

According to an embodiment, in operation 1120, the processor 120 may determine whether a user input associated with adjusting a brightness of the display 160 is received. For example, when there is no user input, the processor 120 may move to operation 1180 to perform the auto brightness operation based on a current auto brightness table (e.g., a reference table). When there is the user input, the processor 120 may perform operation 1130.

According to an embodiment, in operation 1130, the processor 120 may change a brightness of the display 160 depending on the user input (e.g., a user input 200 touching and moving a brightness point of a brightness adjustment object 10 displayed on the display 160).

According to an embodiment, in operation 1140, the processor 120 may update and store an auto brightness table based on the user input. For example, the processor 120 may generate (or update) a user table (or an auto brightness table) corresponding to the user input based on methods of FIGS. 4 to 8. The processor 120 may store the user table (or the auto brightness table) in the memory 130.

According to an embodiment, in operation 1150, the processor 120 may determine whether a specified condition of use is met. For example, the specified condition of use may include whether there is a user table greater than a specific time of use or whether there is a user table generated in a specific environment (e.g., an environment where a luminance of the display 160 is adjusted to be high in low external illumination). When the specified condition of use is not met, the processor 120 may move to operation 1180 to perform an auto brightness operation based on the current auto brightness table (e.g., the user table updated in operation 1140). When the specified condition of use is met, the processor 120 may perform operation 1160.

According to an embodiment, in operation 1160, the processor 120 may recommend a user table based on the accumulated auto brightness tables. For example, the processor 120 may recommend the user table on the display 160 in a form shown in FIG. 10. For example, the processor 120 may recommend a user average table described with reference to FIG. 9, an event brightness table described with reference to FIG. 9, or an auto brightness table generated when the battery capacity is less than or equal to a specific value to a user. Herein, such user tables are illustrative, and the configuration and feature of the user table is not limited thereto.

According to an embodiment, in operation 1170, the processor 120 may perform an auto brightness operation based on the user table selected among the recommended user tables. As described above, the processor 120 (or the electronic device 100) may generate and store at least one user table corresponding to at least one user input during a specific period. The processor 120 may generate and recommend a user table specialized in the user (e.g., a user table, a frequency of use of which is high, a user table used in a specific environment, or a user average table based on an illumination average value of accumulated and input user points) using at least one accumulated user table.

Figure 12:
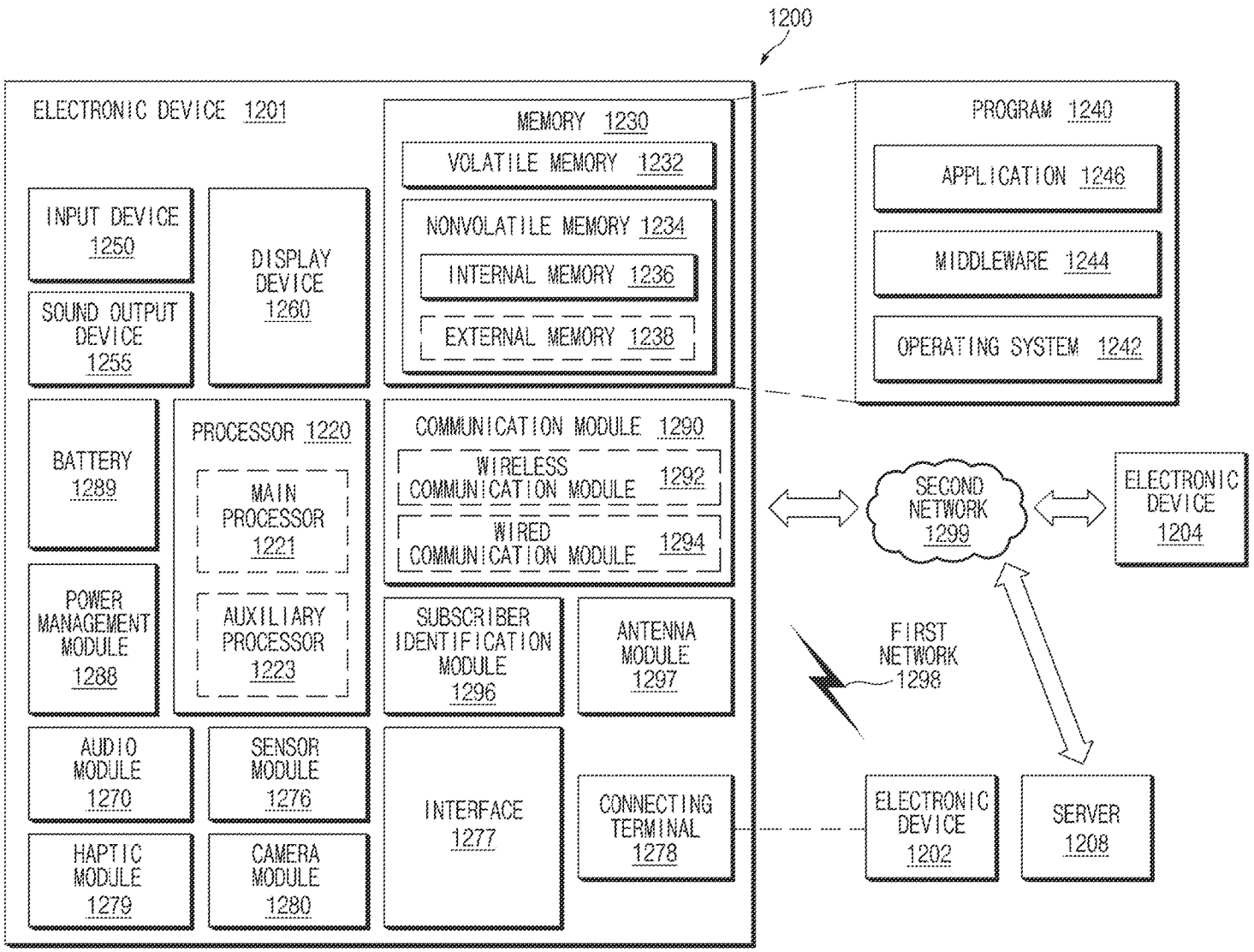
FIG. 12 is a block diagram illustrating an electronic device in a network environment according to an embodiment of the disclosure.

FIG. 12 is a block diagram illustrating an electronic device in a network environment according to an embodiment of the disclosure.

Referring to FIG. 12, the electronic device 1201 in the network environment 1200 may communicate with an electronic device 1202 via a first network 1298 (e.g., a short-range wireless communication network), or an electronic device 1204 or a server 1208 via a second network 1299 (e.g., a long-range wireless communication network). According to an embodiment, the electronic device 1201 may communicate with the electronic device 1204 via the server 1208. According to an embodiment, the electronic device 1201 may include a processor 1220, memory 1230, an input device 1250, a sound output device 1255, a display device 1260, an audio module 1270, a sensor module 1276, an interface 1277, a haptic module 1279, a camera module 1280, a power management module 1288, a battery 1289, a communication module 1290, a subscriber identification module (SIM) 1296, or an antenna module 1297. In some embodiments, at least one (e.g., the display device 1260 or the camera module 1280) of the components may be omitted from the electronic device 1201, or one or more other components may be added in the electronic device 1201. In some embodiments, some of the components may be implemented as single integrated circuitry. For example, the sensor module 1276 (e.g., a fingerprint sensor, an iris sensor, or an illuminance sensor) may be implemented as embedded in the display device 1260 (e.g., a display).

The processor 1220 may execute, for example, software (e.g., a program 1240) to control at least one other component (e.g., a hardware or software component) of the electronic device 1201 coupled with the processor 1220, and may perform various data processing or computation. According to one embodiment, as at least part of the data processing or computation, the processor 1220 may load a command or data received from another component (e.g., the sensor module 1276 or the communication module 1290) in volatile memory 1232, process the command or the data stored in the volatile memory 1232, and store resulting data in non-volatile memory 1234. According to an embodiment, the processor 1220 may include a main processor 1221 (e.g., a central processing unit (CPU) or an application processor (AP)), and an auxiliary processor 1223 (e.g., a graphics processing unit (GPU), an image signal processor (ISP), a sensor hub processor, or a communication processor (CP)) that is operable independently from, or in conjunction with, the main processor 1221. Additionally or alternatively, the auxiliary processor 1223 may be adapted to consume less power than the main processor 1221, or to be specific to a specified function. The auxiliary processor 1223 may be implemented as separate from, or as part of the main processor 1221.

The auxiliary processor 1223 may control at least some of functions or states related to at least one component (e.g., the display device 1260, the sensor module 1276, or the communication module 1290) among the components of the electronic device 1201, instead of the main processor 1221 while the main processor 1221 is in an inactive (e.g., sleep) state, or together with the main processor 1221 while the main processor 1221 is in an active state (e.g., executing an application). According to an embodiment, the auxiliary processor 1223 (e.g., an image signal processor or a communication processor) may be implemented as part of another component (e.g., the camera module 1280 or the communication module 1290) functionally related to the auxiliary processor 1223.

The memory 1230 may store various data used by at least one component (e.g., the processor 1220 or the sensor module 1276) of the electronic device 1201. The various data may include, for example, software (e.g., the program 1240) and input data or output data for a command related thereto. The memory 1230 may include the volatile memory 1232 or the non-volatile memory 1234.

The program 1240 may be stored in the memory 1230 as software, and may include, for example, an operating system (OS) 1242, middleware 1244, or an application 1246.

The input device 1250 may receive a command or data to be used by other component (e.g., the processor 1220) of the electronic device 1201, from the outside (e.g., a user) of the electronic device 1201. The input device 1250 may include, for example, a microphone, a mouse, a keyboard, or a digital pen (e.g., a stylus pen).

The sound output device 1255 may output sound signals to the outside of the electronic device 1201. The sound output device 1255 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 1260 may visually provide information to the outside (e.g., a user) of the electronic device 1201. The display device 1260 may include, for example, a display, a hologram device, or a projector and control circuitry to control a corresponding one of the display, hologram device, and projector. According to an embodiment, the display device 1260 may include touch circuitry adapted to detect a touch, or sensor circuitry (e.g., a pressure sensor) adapted to measure the intensity of force incurred by the touch.

The audio module 1270 may convert a sound into an electrical signal and vice versa. According to an embodiment, the audio module 1270 may obtain the sound via the input device 1250, or output the sound via the sound output device 1255 or a headphone of an external electronic device (e.g., an electronic device 1202) directly (e.g., wiredly) or wirelessly coupled with the electronic device 1201.

The sensor module 1276 may detect an operational state (e.g., power or temperature) of the electronic device 1201 or an environmental state (e.g., a state of a user) external to the electronic device 1201, and then generate an electrical signal or data value corresponding to the detected state. According to an embodiment, the sensor module 1276 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 1277 may support one or more specified protocols to be used for the electronic device 1201 to be coupled with the external electronic device (e.g., the electronic device 1202) directly (e.g., wiredly) or wirelessly. According to an embodiment, the interface 1277 may include, for example, a high definition multimedia interface (HDMI), a universal serial bus (USB) interface, a secure digital (SD) card interface, or an audio interface.

A connecting terminal 1278 may include a connector via which the electronic device 1201 may be physically connected with the external electronic device (e.g., the electronic device 1202). According to an embodiment, the connecting terminal 1278 may include, for example, a HDMI connector, a USB connector, a SD card connector, or an audio connector (e.g., a headphone connector).

The haptic module 1279 may convert an electrical signal into a mechanical stimulus (e.g., a vibration or a movement) or electrical stimulus which may be recognized by a user via his tactile sensation or kinesthetic sensation. According to an embodiment, the haptic module 1279 may include, for example, a motor, a piezoelectric element, or an electric stimulator.

The camera module 1280 may capture a still image or moving images. According to an embodiment, the camera module 1280 may include one or more lenses, image sensors, image signal processors, or flashes.

The power management module 1288 may manage power supplied to the electronic device 1201. According to one embodiment, the power management module 1288 may be implemented as at least part of, for example, a power management integrated circuit (PMIC).

The battery 1289 may supply power to at least one component of the electronic device 1201. According to an embodiment, the battery 1289 may include, for example, a primary cell which is not rechargeable, a secondary cell which is rechargeable, or a fuel cell.

The communication module 1290 may support establishing a direct (e.g., wired) communication channel or a wireless communication channel between the electronic device 1201 and the external electronic device (e.g., the electronic device 1202, the electronic device 1204, or the server 1208) and performing communication via the established communication channel. The communication module 1290 may include one or more communication processors that are operable independently from the processor 1220 (e.g., the application processor (AP)) and supports a direct (e.g., wired) communication or a wireless communication. According to an embodiment, the communication module 1290 may include a wireless communication module 1292 (e.g., a cellular communication module, a short-range wireless communication module, or a global navigation satellite system (GNSS) communication module) or a wired communication module 1294 (e.g., a local area network (LAN) communication module or a power line communication (PLC) module). A corresponding one of these communication modules may communicate with the external electronic device via the first network 1298 (e.g., a short-range communication network, such as Bluetooth™, wireless-fidelity (Wi-Fi) direct, or infrared data association (IrDA)) or the second network 1299 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 1292 may identify and authenticate the electronic device 1201 in a communication network, such as the first network 1298 or the second network 1299, using subscriber information (e.g., international mobile subscriber identity (IMSI)) stored in the subscriber identification module 1296.

The antenna module 1297 may transmit or receive a signal or power to or from the outside (e.g., the external electronic device) of the electronic device 1201. According to an embodiment, the antenna module 1297 may include an antenna including a radiating element composed of a conductive material or a conductive pattern formed in or on a substrate (e.g., PCB). According to an embodiment, the antenna module 1297 may include a plurality of antennas. In such a case, at least one antenna appropriate for a communication scheme used in the communication network, such as the first network 1298 or the second network 1299, may be selected, for example, by the communication module 1290 (e.g., the wireless communication module 1292) from the plurality of antennas. The signal or the power may then be transmitted or received between the communication module 1290 and the external electronic device via the selected at least one antenna. According to an embodiment, another component (e.g., a radio frequency integrated circuit (RFIC)) other than the radiating element may be additionally formed as part of the antenna module 1297.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 1201 and the external electronic device 1204 via the server 1208 coupled with the second network 1299. Each of the electronic devices 1202 and 1204 may be a device of a same type as, or a different type, from the electronic device 1201. According to an embodiment, all or some of operations to be executed at the electronic device 1201 may be executed at one or more of the external electronic devices 1202, 1204, or 1208. For example, if the electronic device 1201 should perform a function or a service automatically, or in response to a request from a user or another device, the electronic device 1201, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 1201. The electronic device 1201 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases. As used herein, such terms as "1st" and "2nd", or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with", "coupled to", "connected with", or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic", "logic block", "part", or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 1240) including one or more instructions that are stored in a storage medium (e.g., internal memory 1236 or external memory 1238) that is readable by a machine (e.g., the electronic device 1201). For example, a processor (e.g., the processor 1220) of the machine (e.g., the electronic device 1201) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

According to embodiments disclosed in the disclosure, the electronic device may perform an auto brightness operation based on an auto brightness table specialized in the user, when a brightness of a display is changed in an auto brightness mode by the user, thus improving user satisfaction.

According to embodiments disclosed in the disclosure, the electronic device may store a history where the user changes a brightness of the display in an auto brightness mode and may provide an auto brightness table optimized for the user.

In addition, various effects ascertained directly or indirectly through the disclosure may be provided.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device, comprising:

a display;

a sensor configured to measure external illumination;

a memory storing a reference brightness table including one-to-one matching between luminance points indicating luminance values, each of which corresponds to a luminance level of the display and reference illumination values in conjunction with the external illumination, the luminance points having an interval depending on the luminance level; and a processor operatively connected with the display, the sensor, and the memory, wherein the processor is configured to:

control the display at a first luminance corresponding to a first illumination measured by the sensor based on the reference brightness table, and when a user input changing the display to a second luminance in a state where the first illumination is maintained is received, decrease or increase a number of first luminance points included between a second illumination adjacent to the first illumination and the first illumination and generate a user brightness table of matching illumination values between the first illumination and the second illumination with the decreased or increased first luminance points one-to-one.

2. The electronic device of claim 1, wherein the processor is further configured to:

set a luminance point corresponding to the first luminance to a reference point, designate a first reference block including luminance points between a minimum luminance point and the reference point, designate a second reference block including luminance points between a maximum luminance point and the reference point, set a luminance point corresponding to the second luminance to a user point, designate a first user block including luminance points between the minimum luminance point and the user point, and designate a second reference block including luminance points between the maximum luminance point and the user point.

3. The electronic device of claim 2, wherein the processor is further configured to:

calculate a location value of each of luminance points included in the first reference block, the second reference block, the first user block, and a second user block, and wherein the location value of each of the luminance points is obtained by dividing a first value, the first value being obtained by subtracting the minimum luminance point from each of the luminance points, by a second value, the second value being obtained by subtracting "1" from a number of luminance points included in a block to which each of the luminance points belongs.

4. The electronic device of claim 3, wherein the processor is further configured to:

in the user brightness table:

designate an illumination value to be matched to the luminance point included in the first user block to be the same as an illumination value matched to the luminance point included in the first reference block, when a location value of the luminance point included in the first reference block and a location value of the luminance point included in the first user block are the same as each other, and designate an illumination value to be matched to the luminance point included in the second user block to be the same as an illumination value matched to the luminance point included in the second reference block, when a location value of the luminance point included in the second reference block and a location value of the luminance point included in the second user block are the same as each other.

5. The electronic device of claim 3, wherein the processor is further configured to:

in the user brightness table:

calculate an illumination value to be matched to the luminance point included in the first user block based on illumination values matched to two luminance points included in the first reference block having a location value close to a location value of the luminance point included in the first user block, and calculate an illumination value to be matched to the luminance point included in the second user block based on illumination values matched to two luminance points included in the second reference block having a location value close to a location value of the luminance point included in the second user block.

6. The electronic device of claim 2, wherein the processor is further configured to:

in the user brightness table, when the number of the first luminance points is increased, match at least one illumination value included in the first reference block to some luminance points of the first user block without change.

7. The electronic device of claim 6, wherein the processor is further configured to:

in the user brightness table, match a specified illumination value to at least one remaining luminance point except for the some luminance points, in the first user block.

8. The electronic device of claim 6, wherein the processor is further configured to:

in the user brightness table, match a minimum value among at least one illumination value included in the first reference block to at least one remaining luminance point except for the some luminance points, in the first user block.

9. The electronic device of claim 6, wherein the processor is further configured to:

in the user brightness table, match at least one illumination value included in the first reference block to a luminance point adjacent to the user point.

10. The electronic device of claim 1, wherein the processor is further configured to:

during a specific time:

collect at least one user brightness table corresponding to at least one user input, determine whether the at least one user brightness table meets a specified condition of use, and recommend a user brightness table meeting the specified condition of use among at least one user brightness table on the display.

11. The electronic device of claim 1, wherein the processor is further configured to:

collect a plurality of user brightness tables corresponding to a plurality of user inputs, and recommend a user brightness table spending the most time during a total time of use of an auto brightness mode among the plurality of user brightness tables on the display.

12. The electronic device of claim 1, wherein the processor is further configured to:

store an event brightness table corresponding to a user input received in a specific situation, and recommend the event brightness table on the display, when a same or similar situation to the specific situation is determined by the sensor.

13. The electronic device of claim 12, wherein the processor is further configured to:

store a power-saving event table corresponding to a user input received in a power-saving mode, and recommend the power-saving event table on the display, when the power-saving mode is executed.

14. An electronic device, comprising:

a display;

a sensor configured to measure external illumination;

a memory storing a reference brightness table including luminance points corresponding one-to-one to luminance values, the luminance values being represented as consecutive values and having a luminance difference of a certain level, and reference illumination values mapped one-to-one to the luminance points; and a processor configured to:

adjust a luminance of the display at a brightness of luminance corresponding to a specific luminance point depending on the external illumination detected by the sensor, and when receiving a user input associated with changing a reference illumination value, subdivide at least some of lower reference illumination values, each of which has an illumination value less than the changed reference illumination value, to generate more lower user illumination values than a number of the lower reference illumination values and generate a user brightness table including the lower user illumination values.

15. The electronic device of claim 14, wherein the processor is further configured to:

integrate at least some of upper reference illumination values, each of which has an illumination value greater than the changed reference illumination value, to generate less upper user illumination values than a number of the upper reference illumination values and generate the user brightness table including the upper user illumination values.

16. The electronic device of claim 14, wherein the processor is further configured to:

designate a first portion among the lower user illumination values to be the same as the lower reference illumination values.

17. The electronic device of claim 16, wherein the processor is further configured to:

designate a second portion except for the first portion among the lower user illumination values as a specified illumination value.

18. The electronic device of claim 16, wherein the processor is further configured to:

designate a second portion except for the first portion among the lower user illumination values as a minimum value among the lower reference illumination values.

19. An electronic device, comprising:

a display;

a sensor configured to measure external illumination;

a memory storing a reference brightness table including luminance points corresponding one-to-one to luminance values, the luminance values being represented as consecutive values and having a luminance difference of a certain level, and reference illumination values mapped one-to-one to the luminance points; and a processor configured to:

adjust a luminance of the display at a brightness of luminance corresponding to a specific luminance point depending on the external illumination detected by the sensor, and when receiving a user input associated with changing a reference illumination value, subdivide at least some of upper reference illumination values, each of which has an illumination value greater than the changed reference illumination value, to generate more upper user illumination values than a number of the upper reference illumination values and generate a user brightness table including the upper user illumination values.

20. The electronic device of claim 19, wherein the processor is further configured to:

integrate at least some of lower reference illumination values, each of which has an illumination value less than the changed reference illumination value, to generate less lower user illumination values than a number of the lower reference illumination values and generate the user brightness table including the lower user illumination values.

* * * * *